US011591768B2

(12) United States Patent
Matsuyama et al.

(10) Patent No.: US 11,591,768 B2
(45) Date of Patent: Feb. 28, 2023

(54) CONTROL SYSTEM OF WORK MACHINE AND METHOD FOR CONTROLLING WORK MACHINE

(71) Applicant: Komatsu Ltd., Tokyo (JP)

(72) Inventors: Toru Matsuyama, Tokyo (JP); Hikaru Suzuki, Tokyo (JP); Jin Kitajima, Tokyo (JP)

(73) Assignee: KOMATSU LTD., Tokyo (JP)

( * ) Notice: Subject to any disclaimer, the term of this patent is extended or adjusted under 35 U.S.C. 154(b) by 674 days.

(21) Appl. No.: 16/309,123

(22) PCT Filed: Aug. 31, 2017

(86) PCT No.: PCT/JP2017/031502
§ 371 (c)(1),
(2) Date: Dec. 12, 2018

(87) PCT Pub. No.: WO2019/043898
PCT Pub. Date: Mar. 7, 2019

(65) Prior Publication Data
US 2021/0222395 A1 Jul. 22, 2021

(51) Int. Cl.
*E02F 3/43* (2006.01)
*E02F 9/20* (2006.01)
(Continued)

(52) U.S. Cl.
CPC ..... *E02F 3/435* (2013.01); *E02F 9/2004* (2013.01); *E02F 9/2232* (2013.01);
(Continued)

(58) Field of Classification Search
CPC ..... E02F 3/30; E02F 3/32; E02F 3/435; E02F 5/003; E02F 9/262; E02F 9/2232;
(Continued)

(56) References Cited

U.S. PATENT DOCUMENTS 5,784,945 A 7/1998 Krone et al.
5,845,223 A * 12/1998 Song ..... E02F 9/2296 701/50
(Continued)

FOREIGN PATENT DOCUMENTS

CN 105324540 A 2/2016
JP 07-026591 A 1/1995
(Continued)

OTHER PUBLICATIONS

International Search Report dated Nov. 21, 2017, issued for PCT/JP2017/031502.

*Primary Examiner* — Geepy Pe
*Assistant Examiner* — Sean Patrick Reidy
(74) *Attorney, Agent, or Firm* — Locke Lord LLP

(57) ABSTRACT

A control method of a work machine includes: calculating a maximum flow rate of hydraulic oil discharged from a hydraulic pump; calculating a first target speed of working equipment including a bucket based on an operation amount of an operation device operated for driving a plurality of hydraulic actuators to which the hydraulic oil discharged from the hydraulic pump is supplied to drive the working equipment and a distance between the bucket and a target excavation landform; calculating a second target speed of the working equipment based on the maximum flow rate, and the operation amount of the operation device and the distance between the bucket and the target excavation landform; and outputting a control signal for controlling the hydraulic actuators based on a smaller one of the first target speed and the second target speed.

4 Claims, 9 Drawing Sheets

(51) Int. Cl.
*E02F 9/22* (2006.01)
*E02F 9/26* (2006.01)

(52) U.S. Cl.
CPC ..... *E02F 9/2271* (2013.01); *E02F 9/262* (2013.01); *E02F 9/2285* (2013.01); *E02F 9/2292* (2013.01); *E02F 9/2296* (2013.01)

(58) Field of Classification Search
CPC ..... E02F 9/2004; E02F 9/2271; E02F 9/2296; E02F 9/2292; E02F 9/2285; E02F 9/22; E02F 9/2228; F15B 3/00; G05B 19/46
USPC ..... 701/50
See application file for complete search history.

(56) References Cited

U.S. PATENT DOCUMENTS 5,960,378 A * 9/1999 Watanabe ..... E02F 3/437 702/150
5,968,104 A 10/1999 Egawa et al.
6,025,686 A 2/2000 Wickert et al.
2011/0146259 A1* 6/2011 Bauer ..... F15B 11/055 60/449
2014/0350799 A1* 11/2014 Kikuyama ..... B60L 15/20 701/50
2016/0040398 A1* 2/2016 Kitajima ..... E02F 3/32 701/50
2017/0121930 A1 5/2017 Kitajima et al.
2018/0355583 A1* 12/2018 Moriki ..... E02F 3/43

FOREIGN PATENT DOCUMENTS

JP 10-008489 A 1/1998
KR 10-0171389 B1 2/1995
KR 10-2017-0038191 A 4/2017
WO 2015137528 A1 9/2015

* cited by examiner

CONTROL SYSTEM OF WORK MACHINE AND METHOD FOR CONTROLLING WORK MACHINE

FIELD

The present invention relates to a control system of a work machine and a method for controlling the work machine.

BACKGROUND

In a technical field relating to a work machine such as an excavator, there is known a work machine as disclosed in Patent Literature 1. The work machine controls working equipment so that the working equipment moves along a target excavation landform indicating a target shape of an excavation object.

CITATION LIST

Patent Literature

Patent Literature 1: WO 2015/137528 A

SUMMARY

Technical Problem

In an excavation operation using working equipment, there is a possibility that a phenomenon of a drop of the tip of the working equipment occurs at the early stage of excavation (at the start of excavation). As a reason of the drop of the tip of the working equipment, it can be considered that the working equipment is operated so as to move at a high speed at the early stage of the excavation. When the tip of the working equipment drops, there is a possibility that the tip of the working equipment moves beyond a target excavation landform, which reduces the accuracy of excavation.

It is an object of an aspect of the present invention to provide a technique capable of preventing reduction in the accuracy of excavation.

Solution to Problem

According to an aspect of the present invention, a control system of a work machine, the work machine including working equipment, the working equipment including a bucket, an arm, and a boom, the control system comprises: a pump maximum flow rate calculation unit configured to calculate a maximum flow rate of hydraulic oil discharged from a hydraulic pump; a first target speed calculation unit configured to calculate a first target speed of the working equipment on the basis of an operation amount of an operation device that is operated for driving a plurality of hydraulic actuators to which the hydraulic oil discharged from the hydraulic pump is supplied to drive the working equipment and a distance between the bucket and a target excavation landform; a second target speed calculation unit configured to calculate a second target speed of the working equipment on the basis of the maximum flow rate, and the operation amount of the operation device and the distance between the bucket and the target excavation landform; and a working equipment control unit configured to output a control signal for controlling the hydraulic actuators on the basis of a smaller one of the first target speed and the second target speed.

Advantageous Effects of Invention

The aspect of the present invention provides a technique capable of preventing reduction in the accuracy of excavation.

DESCRIPTION OF EMBODIMENTS

Hereinbelow, an embodiment according to the present invention will be described with reference to the drawings. However, the present invention is not limited thereto. Elements of each embodiment described below can be appropriately combined. Further, some of the elements may not be used.

[Work Machine]

Figure 1:
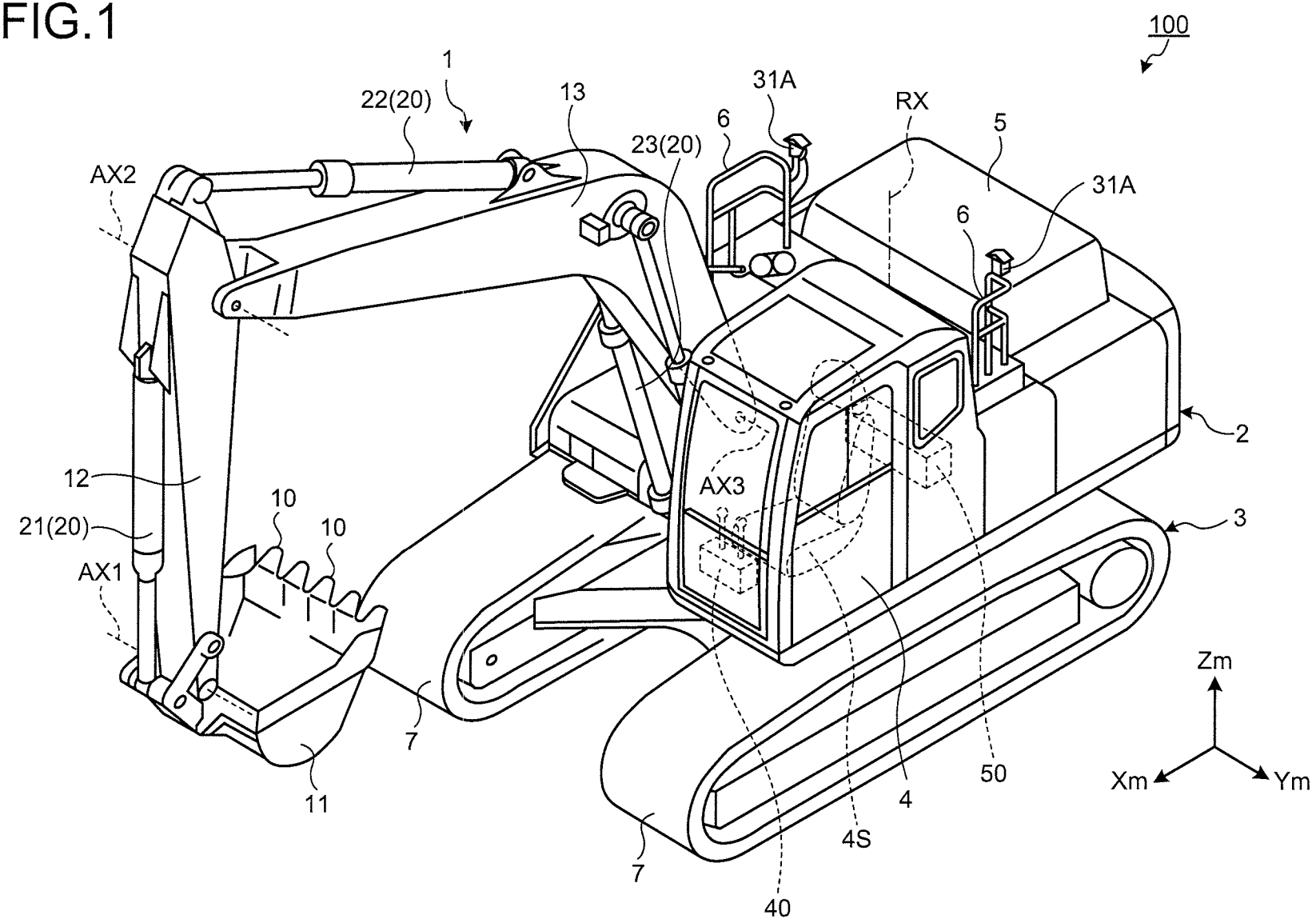
FIG. 1 is a perspective view illustrating an example of an excavator according to the present embodiment.

FIG. 1 is a perspective view illustrating an example of a work machine 100 according to the present embodiment. In the present embodiment, an example in which the work machine 100 is an excavator will be described. In the following description, the work machine 100 is appropriately referred to as the excavator 100.

As illustrated in FIG. 1, the excavator 100 includes working equipment 1 which operates by hydraulic pressure, an upper structure 2 which supports the working equipment 1, an undercarriage 3 which supports the upper structure 2, an operation device 40 for operating the working equipment 1, and a control device 50 which controls the working equipment 1. The upper structure 2 supported by the undercarriage 3 is swingable about a swing axis RX.

The upper structure 2 includes a cab 4 which is occupied by an operator, a machine room 5 in which an engine 17 and a hydraulic pump 42 are housed, and a handrail 6. The cab 4 includes a driver seat 4S on which the operator is seated. The machine room 5 is disposed behind the cab 4. The handrail 6 is disposed in front of the machine room 5.

The undercarriage 3 includes a pair of crawlers 7. The excavator 100 travels by the rotation of the crawlers 7. The undercarriage 3 may be a wheel.

The working equipment 1 is supported by the upper structure 2. The working equipment 1 includes a bucket 11 which includes a blade edge 10, an arm 12 which is coupled to the bucket 11, and a boom 13 which is coupled to the arm 12. The blade edge 10 of the bucket 11 may be the tip of a projecting blade disposed on the bucket 11 or may be the tip of a straight blade disposed on the bucket 11.

The bucket 11 is coupled to the distal end of the arm 12. The proximal end of the arm 12 is coupled to the distal end of the boom 13. The proximal end of the boom 13 is coupled to the upper structure 2.

The bucket 11 and the arm 12 are coupled through a bucket pin. The bucket 11 is supported by the arm 12 rotatably about a rotation axis AX1. The arm 12 and the boom 13 are coupled through an arm pin. The arm 12 is supported by the boom 13 rotatably about a rotation axis AX2. The boom 13 and the upper structure 2 are coupled through a boom pin. The boom 13 is supported by the upper structure 2 rotatably about a rotation axis AX3.

Note that the bucket 11 may be a tilt bucket. The tilt bucket is tiltable in a vehicle width direction by the operation of a bucket tilt cylinder. When the excavator 100 operates on a sloping land, the bucket 11 tilts in the vehicle width direction so that a slope or a flat land can be smoothly formed or leveled.

The operation device 40 is disposed in the cab 4. The operation device 40 includes an operation member which is operated by the operator of the excavator 100. The operation member includes an operation lever or a joystick. The working equipment 1 is operated by operating the operation member.

The control device 50 includes a computer system. The control device 50 includes a processing device which includes a processor such as a central processing unit (CPU), a storage device such as a read only memory (ROM) or a random access memory (RAM), and an input/output interface device.

Figure 2:
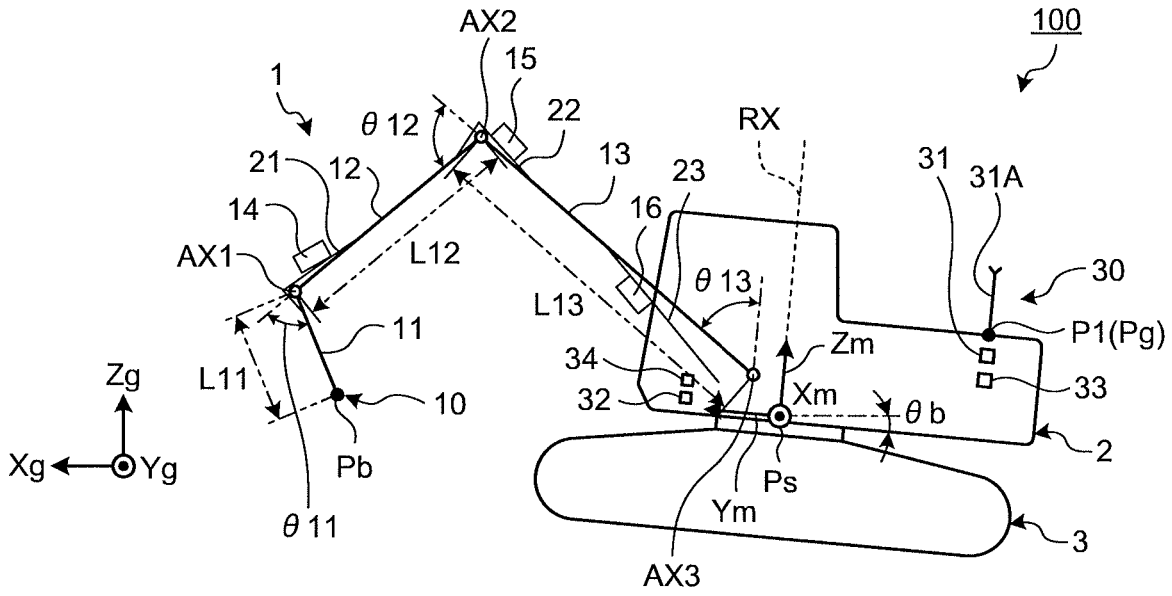
FIG. 2 is a side view schematically illustrating an example of the excavator according to the present embodiment.

FIG. 2 is a side view schematically illustrating the excavator 100 according to the present embodiment. As illustrated in FIGS. 1 and 2, the excavator 100 includes a hydraulic cylinder 20 which drives the working equipment 1. The hydraulic cylinder 20 is a hydraulic actuator which drives the working equipment 1. A plurality of hydraulic cylinders 20 are provided. Hydraulic oil discharged from the hydraulic pump 42 (see, e.g., FIGS. 4 and 5) is supplied to the hydraulic cylinder 20. The hydraulic cylinder 20 is driven by the hydraulic oil. The hydraulic cylinder 20 includes a bucket cylinder 21 which drives the bucket 11, an arm cylinder 22 which drives the arm 12, and a boom cylinder 23 which drives the boom 13.

As illustrated in FIG. 2, the excavator 100 includes a bucket cylinder stroke sensor 14 which is disposed on the bucket cylinder 21, an arm cylinder stroke sensor 15 which is disposed on the arm cylinder 22, and a boom cylinder stroke sensor 16 which is disposed on the boom cylinder 23. The bucket cylinder stroke sensor 14 detects a boom stroke which indicates a movement amount of the bucket cylinder 21. The arm cylinder stroke sensor 15 detects an arm stroke which indicates a movement amount of the arm cylinder 22. The boom cylinder stroke sensor 16 detects a boom stroke which indicates a movement amount of the boom cylinder 23.

The excavator 100 is provided with a position detection device 30 which detects the position of the upper structure 2. The position detection device 30 includes a vehicle body position detector 31 which detects the position of the upper structure 2 which is defined by a global coordinate system, an attitude detector 32 which detects the attitude of the upper structure 2, and a direction detector 33 which detects the direction of the upper structure 2.

The global coordinate system (XgYgZg coordinate system) is a coordinate system indicating an absolute position defined by a global positioning system (GPS). A local coordinate system (XmYmZm coordinate system) is a coordinate system indicating a relative position relative to a reference position Ps of the upper structure 2 of the excavator 100. The reference position Ps of the upper structure 2 is set, for example, at the swing axis RX of the upper structure 2. Note that the reference position Ps of the upper structure 2 may be set at the rotation axis AX3. The position detection device 30 detects the three-dimensional position of the upper structure 2 defined by the global coordinate system, an attitude angle of the upper structure 2 with respect to a horizontal plane, and the direction of the upper structure 2 with respect to a reference direction.

The vehicle body position detector 31 includes a GPS receiver. The vehicle body position detector 31 detects the three-dimensional position of the upper structure 2 defined by the global coordinate system. The vehicle body position detector 31 detects an Xg-direction position, a Yg-direction position, and a Zg-direction position of the upper structure 2.

The upper structure 2 is provided with a plurality of GPS antennas 31A. The GPS antenna 31A receives a radio wave from a GPS satellite and outputs a signal based on the received radio wave to the vehicle body position detector 31. The vehicle body position detector 31 detects an installation position P1 of the GPS antenna 31A defined by the global coordinate system on the basis of the signal supplied from the GPS antenna 31A. The vehicle body position detector 31 detects an absolute position Pg of the upper structure 2 on the basis of the installation position P1 of the GPS antenna 31A.

The vehicle body position detector 31 detects an installation position P1*a* of one of the two GPS antennas 31A and an installation position P1*b* of the other GPS antenna 31A. The vehicle body position detector 31 performs arithmetic processing on the basis of the installation position P1*a* and the installation position P1*b* to detect the absolute position Pg and the direction of the upper structure 2. In the present embodiment, the absolute position Pg of the upper structure 2 is the installation position P1*a*. Note that the absolute position Pg of the upper structure 2 may be the installation position P1*b*.

The attitude detector 32 includes an inertial measurement unit (IMU). The attitude detector 32 is disposed on the upper structure 2. The attitude detector 32 is disposed at the lower part of the cab 4. The attitude detector 32 detects the attitude angle of the upper structure 2 with respect to the horizontal plane (the XgYg plane). The attitude angle of the upper structure 2 with respect to the horizontal plane includes an attitude angle θa of the upper structure 2 in the vehicle width direction and an attitude angle θb of the upper structure 2 in the front-rear direction.

The direction detector 33 has a function of detecting the direction of the upper structure 2 with respect to the reference direction defined by the global coordinate system on the basis of the installation position P1*a* of one GPS antenna 31A and the installation position P1*b* of the other GPS antenna 31A. The reference direction is, for example, the north. The direction detector 33 performs arithmetic processing on the basis of the installation position P1*a* and the installation position P1*b* to detect the direction of the upper structure 2 with respect to the reference direction. The direction detector 33 calculates a straight line connecting the installation position P1*a* and the installation position P1*b* and detects the direction of the upper structure 2 with respect to the reference direction on the basis of an attitude angle θc formed between the calculated straight line and the reference direction.

Note that the direction detector 33 may be separated from the position detection device 30. The direction detector 33 may detect the direction of the upper structure 2 using a magnetic sensor.

The excavator 100 is provided with a blade edge position detector 34 which detects the relative position of the blade edge 10 with respect to the reference position Ps of the upper structure 2.

In the present embodiment, the blade edge position detector 34 detects the relative position of the blade edge 10 with respect to the reference position Ps of the upper structure 2 on the basis of a detection result of the bucket cylinder stroke sensor 14, a detection result of the arm cylinder stroke sensor 15, a detection result of the boom cylinder stroke sensor 16, a length L11 of the bucket 11, a length L12 of the arm 12, and a length L13 of the boom 13.

The blade edge position detector 34 calculates an attitude angle θ11 of the blade edge 10 of the bucket 11 with respect to the arm 12 on the basis of detection data of the bucket cylinder stroke sensor 14. The blade edge position detector 34 detects an attitude angle θ12 of the arm 12 with respect to the boom 13 on the basis of detection data of the arm cylinder stroke sensor 15. The blade edge position detector 34 calculates an attitude angle θ13 of the boom 13 with respect to a Z-axis of the upper structure 2 on the basis of detection data of the boom cylinder stroke sensor 16.

The length L11 of the bucket 11 is a distance between the blade edge 10 of the bucket 11 and the rotation axis AX1 (the bucket pin). The length L12 of the arm 12 is a distance between the rotation axis AX1 (the bucket pin) and the rotation axis AX2 (the arm pin). The length L13 of the boom 13 is a distance between the rotation axis AX2 (the arm pin) and the rotation axis AX3 (the boom pin).

The blade edge position detector 34 detects the relative position of the blade edge 10 with respect to reference position Ps of the upper structure 2 on the basis of the attitude angle θ11, the attitude angle θ12, the attitude angle θ13, the length L11, the length L12, and the length L13.

Further, the blade edge position detector 34 detects the absolute position Pb of the blade edge 10 on the basis of the absolute position Pg of the upper structure 2 detected by the position detection device 30 and the relative position between the reference position Ps of the upper structure 2 and the blade edge 10. The relative position between the absolute position Pg and the reference position Ps is known data derived from design data or specification data of the excavator 100. Thus, the blade edge position detector 34 is capable of calculating the absolute position Pb of the blade edge 10 on the basis of the absolute position Pg of the upper structure 2, the relative position between the reference position Ps of the upper structure 2 and the blade edge 10, and the design data or the specification data of the excavator 100.

Note that, in the present embodiment, the cylinder stroke sensors 14, 15, 16 are used to detect the attitude angles θ11, θ12, θ13. However, the cylinder stroke sensors 14, 15, 16 may not be used. For example, the blade edge position detector 34 may detect the attitude angle θ11 of the bucket 11, the attitude angle θ12 of the arm 12, and the attitude angle θ13 of the boom 13 using an angle sensor such as a potentiometer or a level.

[Action of Working Equipment]

The operation device 40 is operated for driving the plurality of hydraulic actuators 20 which drive the working equipment 1. A dumping action of the bucket 11, an excavation action of the bucket 11, a dumping action of the arm 12, an excavation action of the arm 12, a raising action of the boom 13, and a lowering action of the boom 13 are executed by operating the operation device 40.

The bucket 11 performs the excavation action by extension of the bucket cylinder 21 and performs the dumping action by contraction of the bucket cylinder 21. The arm 12 performs the excavation action by extension of the arm cylinder 22 and performs the dumping action by contraction of the arm cylinder 22. The boom 13 performs the raising action by extension of the boom cylinder 23 and performs the lowering action by contraction of the boom cylinder 23.

In the present embodiment, the operation device 40 includes a right operation lever which is disposed on the right side of an operator who is seated on the driver seat 4S and a left operation lever which is disposed on the left side of the operator.

[Ground Leveling Assist Control]

Figure 3:
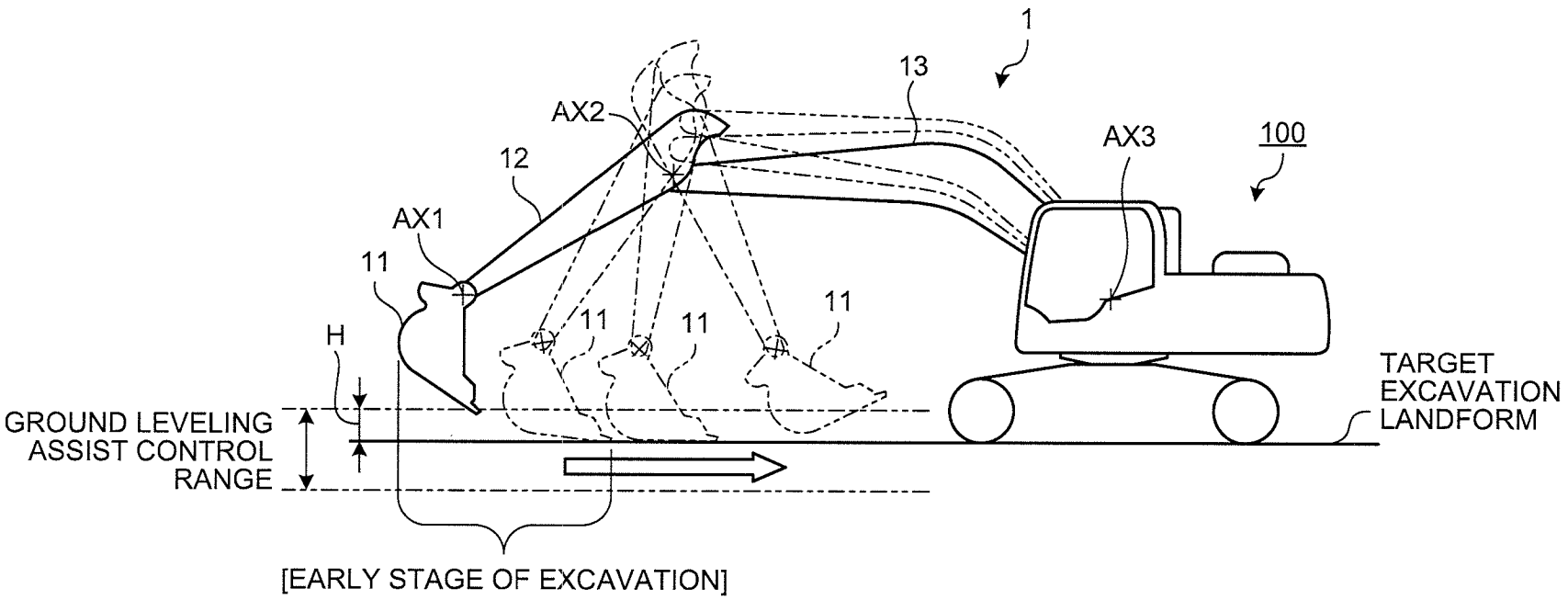
FIG. 3 is a schematic diagram for describing an example of the action of working equipment which is driven in accordance with working equipment control according to the present embodiment.

FIG. 3 is a schematic diagram for describing an example of the action of the working equipment 2 which is driven in accordance with ground leveling assist control according to the present embodiment.

The ground leveling assist control indicates controlling the working equipment 1 so that the bucket 11 moves along a target excavation landform indicating a target shape of an excavation object. In the ground leveling assist control, the boom cylinder 23 is controlled so that the boom 13 performs the raising action so that the bucket 11 does not move beyond the target excavation landform.

In the ground leveling assist control, the bucket 11 and the arm 12 are driven in accordance with the operation of the operation device 40 by the operator. The boom 13 is driven in accordance with the control by the control device 50.

As illustrated in FIG. 3, in the present embodiment, the ground leveling assist control is performed so that the blade edge 10 of the bucket 11 moves along the target excavation landform.

[Hydraulic System]

Next, an example of a hydraulic system 300 according to the present embodiment will be described. The hydraulic cylinder 20 which includes the bucket cylinder 21, the arm cylinder 22, and the boom cylinder 23 operates by the hydraulic system 300. The hydraulic cylinder 20 is operated by at least either the operation device 40 or the control device 50.

Figure 4:
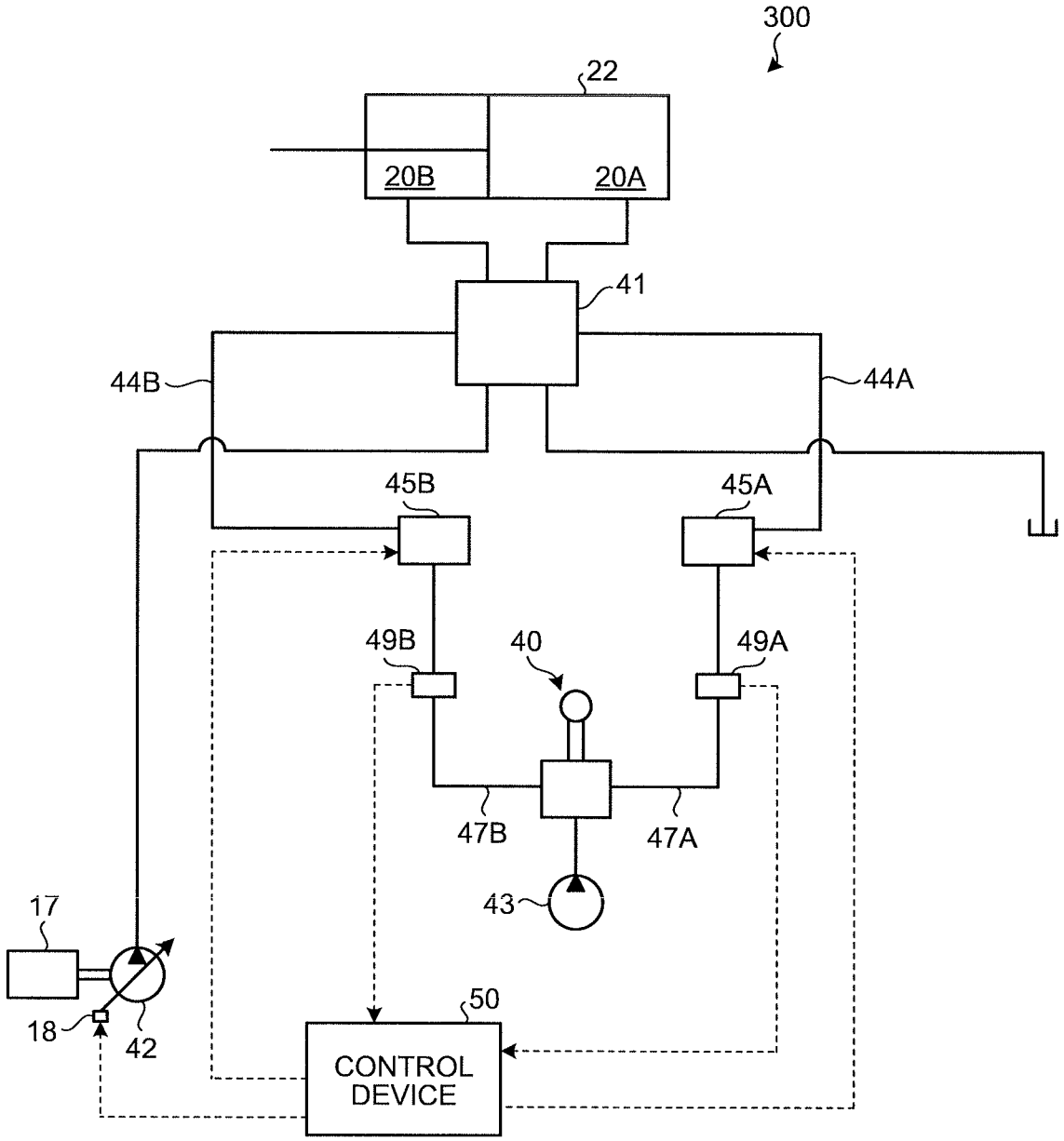
FIG. 4 is a schematic diagram illustrating an example of a hydraulic system according to the present embodiment.

FIG. 4 is a schematic diagram illustrating an example of the hydraulic system 300 which operates the arm cylinder 22. The arm 12 executes two kinds of actions: the excavation action; and the dumping action by the operation of the operation device 40. The hydraulic system 300 which operates the arm cylinder 22 is provided with the hydraulic pump 42 which supplies hydraulic oil to the arm cylinder 22 through a direction control valve 41, a hydraulic pump 43 which supplies pilot oil, oil passages 44A, 44B which are connected to the direction control valve 41 and through which pilot oil flows, oil passages 47A, 47B which are connected to the operation device 40 and through which pilot oil flows, control valves 45A and 45B which are connected to the oil passages 44A, 47A and the oil passages 44B, 47B, respectively, to adjust a pilot pressure acting on the direction control valve 41, pressure sensors 49A, 49B which are disposed on the oil passages 47A, 47B, and the control device 50 which controls the control valves 45A, 45B.

The hydraulic pump 42 is driven by the engine 17. The engine 17 is a power source of the excavator 1. The engine 17 is, for example, a diesel engine. The hydraulic pump 42 is coupled to an output shaft of the engine 17, and discharges hydraulic oil by driving of the engine 17. The hydraulic cylinder 20 operates on the basis of the hydraulic oil discharged from the hydraulic pump 42.

The hydraulic pump 42 is a variable displacement hydraulic pump. In the present embodiment, the hydraulic pump 42 is a swash plate hydraulic pump. A swash plate of the hydraulic pump 42 is driven by a servomechanism 18. The servomechanism 18 adjusts the angle of the swash plate to adjust a capacity [cc/rev] of the hydraulic pump 42. The capacity of the hydraulic pump 42 indicates a discharge amount [cc/rev] of hydraulic oil discharged from the hydraulic pump 42 when the output shaft of the engine 17 coupled to the hydraulic pump 42 makes one revolution.

The control valves 45A, 45B are solenoid proportional control valves. Pilot oil delivered from a hydraulic pump 43 is supplied to the control valves 45A, 45B through the operation device 40 and the oil passages 47A, 47B. Note that pilot oil delivered from the hydraulic pump 42 and decompressed by a pressure reducing valve may be supplied to the control valves 45A, 45B. The control valves 45A, 45B adjust the pilot pressure acting on the direction control valve 41 in accordance with a control signal from the control device 50. The control valve 45A adjusts the pilot pressure in the oil passage 44A. The control valve 45B adjusts the pilot pressure in the oil passage 44B.

The direction control valve 41 controls a flow rate and a flow direction of hydraulic oil. Hydraulic oil supplied from the hydraulic pump 42 is supplied to the arm cylinder 22 through the direction control valve 41. The direction control valve 41 makes a switch between the supply of hydraulic oil to a cap side oil chamber 20A of the arm cylinder 22 and the supply of hydraulic oil to a rod side oil chamber 20B. The cap side oil chamber 20A is a space between a cylinder head cover and a piston. The rod side oil chamber 20B is a space in which a piston rod is disposed.

The operation device 40 is connected to the hydraulic pump 43. Pilot oil delivered from the hydraulic pump 43 is supplied to the operation device 40. Note that pilot oil delivered from the hydraulic pump 42 and decompressed by the pressure reducing valve may be supplied to the operation device 40.

Figure 5:
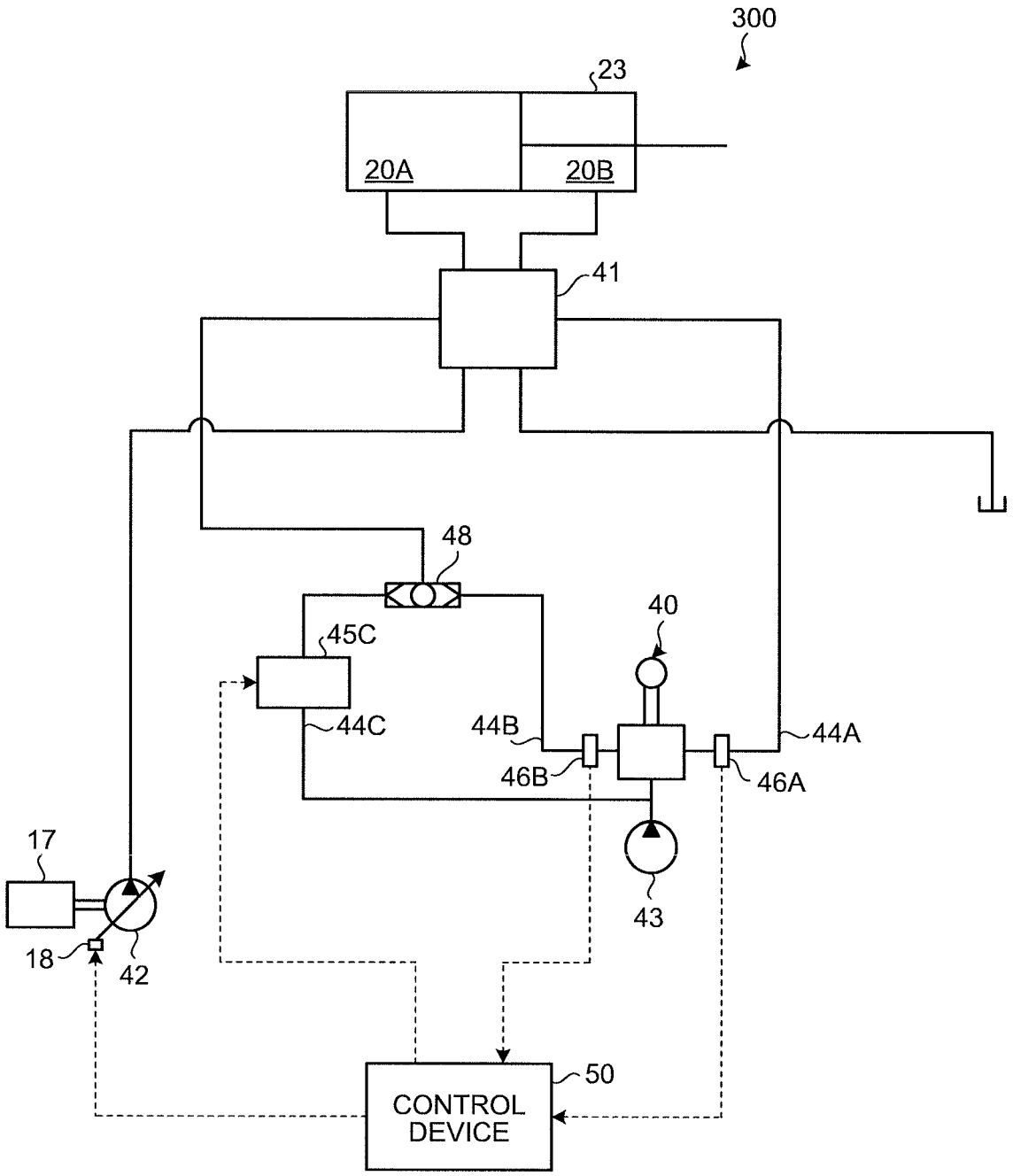
FIG. 5 is a schematic diagram illustrating an example of the hydraulic system according to the present embodiment.

FIG. 5 is a schematic diagram illustrating an example of the hydraulic system 300 which operates the boom cylinder 23. The boom 13 executes two kinds of actions: the raising action; and the lowering action by the operation of the operation device 40. The hydraulic system 300 which operates the boom cylinder 23 is provided with the hydraulic pump 42, the hydraulic pump 43, the direction control valve 41, oil passages 44A, 44B, 44C through which pilot oil flows, a control valve 45C which is disposed on the oil passage 44C, pressure sensors 46A, 46B which are disposed on the oil passages 44A, 44B, and the control device 50 which controls the control valve 45C.

The control valve 45C is a solenoid proportional control valve. The control valve 45C adjusts the pilot pressure in accordance with a command signal from the control device 50. The control valve 45C adjusts the pilot pressure in the oil passage 44C.

When the operation device 40 is operated, a pilot pressure according to an operation amount of the operation device 40 acts on the direction control valve 41. A spool of the direction control valve 41 moves according to the pilot pressure. A supply amount per unit time of hydraulic oil supplied from the hydraulic pump 42 to the boom cylinder 23 through the direction control valve 41 is adjusted on the basis of a movement amount of the spool.

In the present embodiment, the control valve 45C which operates in accordance with a control signal relating to the ground leveling assist control, the control signal being output from the control device 50, is disposed on the oil passage 44C for the ground leveling assist control. Pilot oil delivered from the hydraulic pump 43 flows through the oil passage 44C. The oil passage 44B and the oil passage 44C are connected to a shuttle valve 48. The shuttle valve 48 supplies pilot oil flowing through either the oil passage 44B or the oil passage 44C having a higher pilot pressure to the direction control valve 41. The control valve 45C is controlled in accordance with the control signal output from the control device 50 for executing the ground leveling assist control.

When the ground leveling assist control is not executed, the control device 50 outputs no control signal to the control valve 45C so that the direction control valve 41 is driven on the basis of the pilot pressure adjusted by the operation of the operation device 40. For example, the control device 50 closes the oil passage 44C by the control valve 45C so that the direction control valve 41 is driven on the basis of the pilot pressure adjusted by the operation of the operation device 40.

When the ground leveling assist control is executed, the control device 50 controls the control valve 45C so that the direction control valve 41 is driven on the basis of the pilot pressure adjusted by the control valve 45C. For example, when the ground leveling assist control which restricts the movement of the boom 13 is executed, the control device 50 brings the control valve 45C into a fully-open state so as to achieve a pilot pressure according to a boom target speed. When the pilot pressure in the oil passage 44C becomes larger than the pilot pressure in the oil passage 44B, pilot oil from the control valve 45C is supplied to the direction control valve 41 through the shuttle valve 48. Accordingly, the boom cylinder 23 extends, and the boom 13 performs the raising action.

The bucket cylinder 21 operates on the basis of the operation amount of the operation device 40. Description for the hydraulic system 300 which operates the bucket cylinder 21 will be omitted.

Note that the operation device 40 may be an electric operation device. For example, the operation device 40 may include an operation member such as an electric lever and a movement amount sensor such as a potentiometer which electrically detects a tilt amount of the operation member. Detection data of the movement amount sensor is output to the control device 50. The control device 50 acquires the detection data of the movement amount sensor as the operation amount of the operation device 40. The control device 50 may output a control signal for driving the direction control valve 41 on the basis of the detection data of the movement amount sensor. Further, the direction control valve 41 may be driven by an actuator such as a solenoid which operates by electric power.

[Control System]

Figure 6:
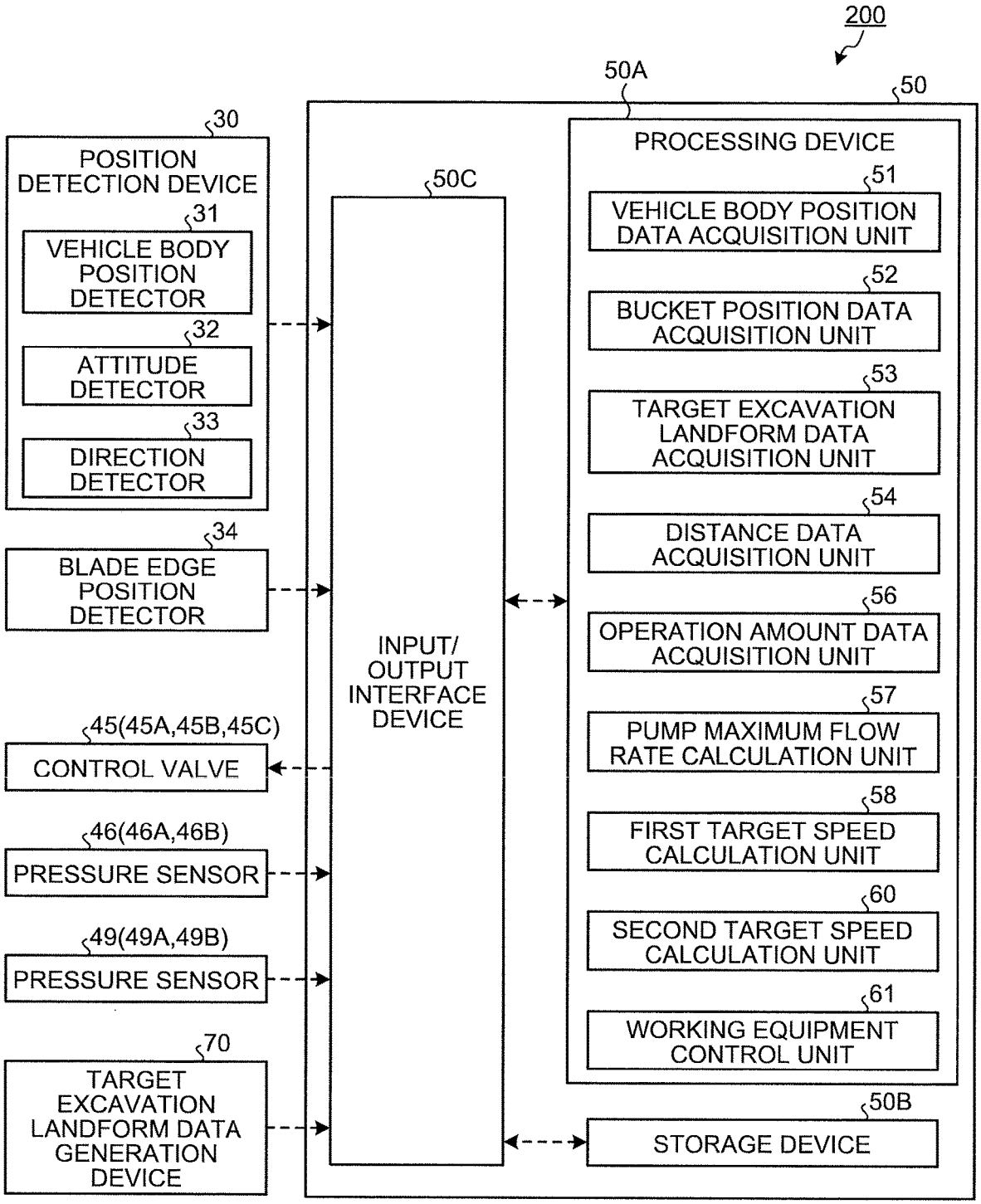
FIG. 6 is a functional block diagram illustrating an example of a control device according to the present embodiment.

Next, a control system 200 of the excavator 100 according to the present embodiment will be described. FIG. 6 is a functional block diagram illustrating an example of the control system 200 according to the present embodiment.

As illustrated in FIG. 6, the control system 200 is provided with the control device 50 which controls the working equipment 1, the position detection device 30, the blade edge position detector 34, a control valve 45 (45A, 45B, 45C), a pressure sensor 46 (46A, 46B), a pressure sensor 49 (49A, 49B), and a target excavation landform data generation device 70.

As described above, the position detection device 30 which includes the vehicle body position detector 31, the attitude detector 32, and the direction detector 33 detects the absolute position Pg of the upper structure 2. In the following description, the absolute position Pg of the upper structure 2 is appropriately referred to as a vehicle body position Pg.

The control valve 45 (45A, 45B, 45C) adjusts the flow rate of hydraulic oil supplied to the hydraulic cylinder 20. The control valve 45 operates in accordance with a control signal from the control device 50. The pressure sensor 46 (46A, 46B) detects the pilot pressure in the oil passage 44 (44A, 44B). The pressure sensor 49 (49A, 49B) detects the pilot pressure in an oil passage 47 (47A, 47B). Detection data of the pressure sensor 46 and detection data of the pressure sensor 49 are output to the control device 50.

The target excavation landform data generation device 70 includes a computer system. The target excavation landform data generation device 70 generates a target excavation landform indicating a target shape of an excavation object. The target excavation landform indicates a three-dimensional target shape which is obtained after the execution of construction work by the working equipment 1.

Note that the target excavation landform data generation device 70 and the control device 50 may be connected by wire to transmit the target excavation landform from the target excavation landform data generation device 70 to the control device 50. Note that the target excavation landform data generation device 70 may include a storage medium in which the target excavation landform is stored, and the control device 50 may include a device capable of reading data indicating the target excavation landform.

The control device 50 includes a computer system. The control device 50 includes a processing device 50A, a storage device 50B, and an input/output interface device 50C.

The processing device 50A includes a vehicle body position data acquisition unit 51, a bucket position data acquisition unit 52, a target excavation landform data acquisition unit 53, a distance data acquisition unit 54, an operation amount data acquisition unit 56, a pump maximum flow rate calculation unit 57, a first target speed calculation unit 58, a second target speed calculation unit 60, and a working equipment control unit 61.

The vehicle body position data acquisition unit 51 acquires vehicle body position data indicating the vehicle body position Pg from the position detection device 30 through the input/output interface device 50C. The vehicle body position detector 31 detects the vehicle body position Pg on the basis of at least either the installation position P1*a* or the installation position P1*b* of the GPS antenna 31. The vehicle body position data acquisition unit 51 acquires vehicle body position data indicating the vehicle body position Pg from the vehicle body position detector 31.

The bucket position data acquisition unit 52 acquires bucket position data including the position of the bucket 11 from the blade edge position detector 34 through the input/output interface 500. The bucket position data includes a relative position of the blade edge 10 with respect to the reference position Ps of the upper structure 2.

The target excavation landform data acquisition unit 53 generates target excavation landform data corresponding to the position of the bucket 11 using data indicating the target excavation landform supplied from the target excavation landform data generation device 70 and the position of the bucket 11.

The distance data acquisition unit 54 calculates a distance D between the bucket 11 and the target excavation landform on the basis of the position of the bucket 11 acquired by the bucket position data acquisition unit 52 and the target excavation landform generated by the target excavation landform data acquisition unit 53.

Note that the distance D between the bucket 11 and the target excavation landform may be either a distance between the blade edge 10 of the bucket 11 and the target excavation landform or a distance between any position in the bucket 11 including the bottom face of the bucket 11 and the target excavation landform.

The operation amount data acquisition unit 56 acquires operation amount data indicating the operation amount of the operation device 40 which operates the working equipment 1. An operation amount of the bucket 11, an operation amount of the arm 12, an operation amount of the boom 13 are in correlation with the detection data of the pressure sensor 46 or the detection data of the pressure sensor 49. Correlation data indicating the correlation between the operation amount of the operation device 40 and the detection data of the pressure sensor 46 or the detection data of the pressure sensor 49 is obtained in advance by a preparatory experiment or a simulation and stored in the storage device 50B. The operation amount data acquisition unit 56 can calculate the operation amount of the operation device 40 on the basis of the detection data of the pressure sensor 46 or the detection data of the pressure sensor 49 and the correlation data stored in the storage device 50B.

For example, the operation amount data acquisition unit 56 can acquire data indicating the operation amount of the operation device 40 (left operation lever) operating the arm 12 on the basis of the detection data of the pressure sensors 49A, 49B and the correlation data stored in the storage device 50B. Similarly, the operation amount data acquisition unit 56 can acquire data indicating the operation amount of the operation device 40 (right operation lever) operating the boom 13 on the basis of the detection data of the pressure sensors 46A, 46B and the correlation data stored in the storage device 50B.

The pump maximum flow rate calculation unit 57 calculates a maximum flow rate Qmax of hydraulic oil discharged from the hydraulic pump 42. The maximum flow rate Qmax indicates an upper limit of a flow rate Q [l/min] of hydraulic oil that can be discharged by the hydraulic pump 42 at a certain time point. In a state where the operation device 40 is not operated, hydraulic oil is discharged from the hydraulic pump 42 at a low flow rate Qmin including zero. The characteristic of the maximum flow rate Qmax is determined in such a manner that the flow rate Q gradually increases from an operation start point when the operation of the operation device 40 is started and reaches the maximum flow rate Qmax of hydraulic oil that can be discharged by the hydraulic pump 42.

The maximum flow rate Qmax is calculated, for example, on the basis of at least either the capacity [cc/rev] of the hydraulic pump 42 or an engine speed [rpm] of the engine 17 which drives the hydraulic pump 42. The pump maximum flow rate calculation unit 57 can calculate the maximum flow rate Qmax, for example, on the basis of an upper limit of the capacity of the hydraulic pump 42 and an upper limit of the engine speed of the engine 17. When a throttle dial is disposed in the cab 4 of the excavator 1, the operator can set the upper limit of the engine speed of the engine 17 by operating the throttle dial. The pump maximum flow rate calculation unit 57 can calculate the maximum flow rate Qmax on the basis of an operation amount of the throttle dial. That is, the maximum flow rate Qmax that has gradually increased from the operation start point becomes a fixed value when reaching the maximum flow rate Qmax based on the operation amount of the throttle dial. The fixed value varies according to the operation amount of the throttle dial.

The first target speed calculation unit 58 calculates a first target speed of the working equipment 1 on the basis of the operation amount of the operation device 40 and the distance D between the bucket 11 and the target excavation landform. That is, the first target speed calculation unit 58 calculates the first target speed on the basis of the operation amount of the operation device 40 and the distance D.

The first target speed includes a bucket cylinder target speed Vbk of the bucket cylinder 21, an arm cylinder target speed Var of the arm cylinder 22, and a boom cylinder target speed Vbm of the boom cylinder 23.

As described above with reference to FIG. 3, the ground leveling assist control is performed when at least a part of the bucket 11 is present within a ground leveling assist control range. When the bucket 11 is not present within the ground leveling assist control range, the working equipment 2 is driven on the basis of the operation amount of the operation device 40.

On the other hand, when the bucket 11 is present within the ground leveling assist range, the first target speed calculation unit 58 calculates the first target speed on the basis of the operation amount of the operation device 40 and the distance D between the bucket 11 and the target excavation landform.

That is, when the distance D between the target excavation landform and the bucket 11 is equal to or less than a threshold H, and the ground leveling assist control is performed, the first target speed calculation unit 58 calculates a working equipment speed limit Vt on the basis of the operation amount of the operation device 40 and the distance D. The working equipment speed limit Vt indicates a speed limit of the entire working equipment 1 for the ground leveling assist control, the speed limit being calculated on the basis of the operation amount of the operation device 40 and the distance D. As the distance D decreases, the working equipment speed limit Vt decreases. When the distance D becomes zero, the working equipment speed limit Vt also becomes zero.

The working equipment speed limit Vt indicates the speed limit of the entire working equipment 1. The speed of the entire working equipment 1 indicates an actual acting speed of the bucket 11 when the bucket 11, the arm 12, and the boom 13 are driven. Further, the first target speed calculation unit 58 calculates the boom cylinder target speed Vbm on the basis of the working equipment speed limit Vt. The first target speed calculation unit 58 calculates the arm cylinder target speed Vam and the bucket cylinder target speed Vbk on the basis of the operation amount of the operation device 40 by the operator. That is, in the present embodiment, the first target speed calculation unit 58 calculates the working equipment speed limit Vt and the boom cylinder target speed Vbm so that a deviation between the speed of the entire working equipment 1 according to at least the arm operation amount and the bucket operation amount acquired by the operation amount data acquisition unit 56 and the working equipment speed limit Vt is cancelled. In the first target speed calculation unit 58, the movement of the bucket 11 and the movement of the arm 12 are based on the operation of the operation device 40 by the operator. In the ground leveling assist control, the first target speed calculation unit 58 calculates the boom cylinder target speed Vbm of the boom 10 which performs the raising action so that the blade edge 10 of the bucket 11 moves along the target excavation landform in a state where the bucket 11 and the arm 12 are operated by the operation device 40.

The second target speed calculation unit 60 calculates a second target speed of the working equipment 1 on the basis of the maximum flow rate Qmax calculated by the pump maximum flow rate calculation unit 57, and the operation amount of the operation device 40 and the distance D. That is, the second target speed calculation unit 60 calculates the second target speed on the basis of the maximum flow rate Qmax, the operation amount of the operation device 40, and the distance D.

The second target speed calculation unit 60 calculates a required flow rate Qdbm of hydraulic oil required for the boom cylinder 23 to operate the boom 13 at the boom cylinder target speed Vbm. The second target speed calculation unit 60 calculates a required flow rate Qdar of hydraulic oil required for the arm cylinder 22 to operate the arm 12 at the arm cylinder target speed Var.

In the following description, the sum of the required flow rates Qd of a plurality of hydraulic cylinders 20 is referred to as a total flow rate Qdal. Note that a required flow rate Qdbk of the bucket cylinder 21 is often lower than the required flow rate Qdar of the arm cylinder 22 and the required flow rate Qdbm of the boom cylinder 23. Thus, in the present embodiment, for simplifying the description, it is assumed that the total flow rate Qdal is the sum of the required flow rate Qdar of the arm cylinder 22 and the required flow rate Qdbm of the boom cylinder 23.

The second target speed of the working equipment 1 indicates a bucket cylinder target speed Vbk, an arm cylinder target speed Var, and a boom cylinder target speed Vbm which are calculated by recalculating the target speed on the basis of the maximum flow rate Qmax calculated by the pump maximum flow rate calculation unit 57 and the working equipment speed limit Vt calculated on the basis of the operation amount of the operation device 40 and the distance D. As described above, the first target speed calculation unit 58 calculates the first target speed on the basis of the operation amount of the operation device 40 and the distance D. The second target speed calculation unit 60 calculates the second target speed on the basis of the maximum flow rate Qmax, and the operation amount of the operation device 40 and the distance D.

In the present embodiment, the second target speed calculation unit 60 calculates the second target speed of the working equipment 1 in the ground leveling assist control so that the total flow rate Qdal indicating the sum of the required flow rate Qdar of the arm cylinder 22 and the required flow rate Qdbm of the boom cylinder 23 becomes the maximum flow rate Qmax calculated by the pump maximum flow rate calculation unit 57.

That is, in the present embodiment, the second target speed calculation unit 60 recalculates the bucket cylinder target speed Vbk, the arm cylinder target speed Var, and the boom cylinder target speed Vbm which are calculated by the first target speed calculation unit 58 using, as constraint conditions, the maximum flow rate Qmax calculated by the pump maximum flow rate calculation unit 57 and the working equipment speed limit Vt calculated on the basis of the operation amount of the operation device 40 and the distance D to calculate recalculated values of the arm cylinder target speed Var and the boom cylinder target speed Vbm.

When Qmax denotes the maximum flow rate calculated by the pump maximum flow rate calculation unit 57, Vs denotes the speed of the bucket 11 by the operation of the arm cylinder 22 when the working equipment 1 is operated so as to have the working equipment speed limit Vt calculated on the basis of the operation amount of the operation device 40 and the distance D, Qdar denotes the required flow rate of the arm cylinder 22 when the working equipment 1 is operated so as to have the working equipment speed limit Vt, Vb denotes the speed of the bucket 11 by the operation of the boom cylinder 23 when the working equipment 1 is operated so as to have the working equipment speed limit Vt, and Qdbm denotes the required flow rate of the boom cylinder 23 when the working equipment 1 is operated so as to have the working equipment speed limit Vt, the second target speed calculation unit 60 arithmetically processes the following simultaneous equations to calculate recalculated values of the arm cylinder target speed Var and the boom cylinder target speed Vbm. That is, the second target speed calculation unit 60 calculates the recalculated value of the required flow rate of each cylinder so that the sum of the required flow rate Qdar of the arm cylinder 22 and the required flow rate Qdbm of the boom cylinder 23 satisfies the maximum flow rate Qmax, and the sum of the speed Vs of the bucket 11 by the operation of the arm cylinder 22 and the speed Vb of the bucket 11 by the operation of the boom cylinder 23 becomes the working equipment speed limit Vt.

$$\begin{cases} Q_{max} = Q_{dar} + Q_{dbm} \\ Vt = Vs + Vb \end{cases}$$

In the following description, the arm cylinder target speed Var calculated by the first target speed calculation unit 58 is appropriately referred to as an arm cylinder target speed Var_b before recalculation, and the arm cylinder target speed Var calculated by recalculation by the second target speed calculation unit 60 is appropriately referred to as an arm cylinder target speed Var_a after recalculation. Further, the boom cylinder target speed Vbm calculated by the first target speed calculation unit 58 is appropriately referred to as a boom cylinder target speed Vbm_b before recalculation, and the boom cylinder target speed Vbm calculated by recalculation by the second target speed calculation unit 60 is appropriately referred to as a boom cylinder target speed Vbm_a after recalculation. That is, in the present embodiment, the first target speed is a target speed of the working equipment 1 before recalculation, and the second target speed is a target speed of the working equipment 1 after recalculation.

The working equipment control unit 61 outputs a control signal for controlling the hydraulic cylinder 20 to the control valve 45 so that the working equipment 1 operates at the target speed. In the present embodiment, the working equipment control unit 61 outputs the control signal for controlling the hydraulic cylinder 20 on the basis of the smaller one of the first target speed and the second target speed.

Figure 7:
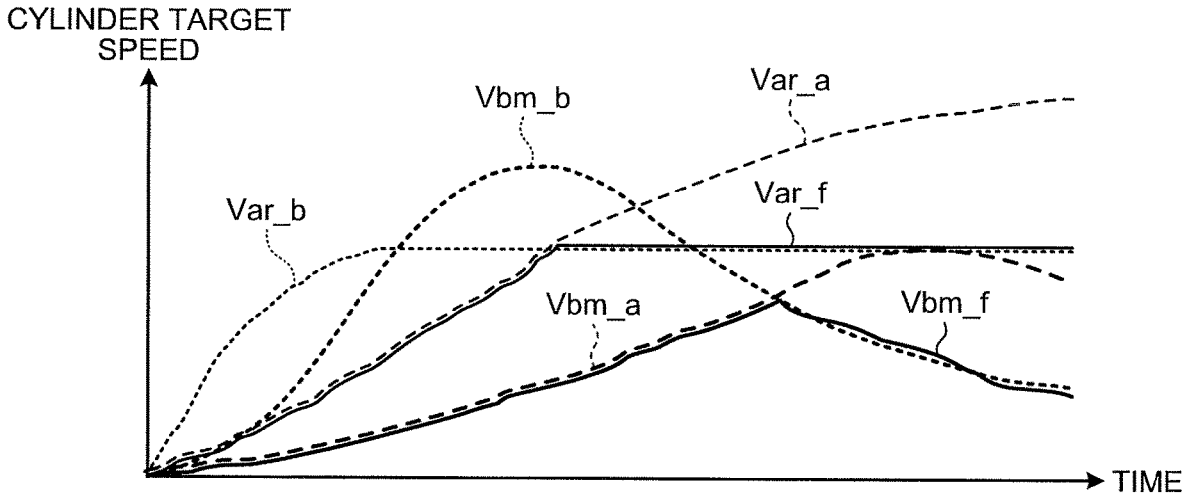
FIG. 7 is a diagram for describing a method for determining a target speed of the working equipment according to the present embodiment.

FIG. 7 is a diagram for describing a method for determining the target speed of the working equipment 1 according to the present embodiment. In the graph illustrated in FIG. 7, the horizontal axis represents an elapsed time from a time point when the ground leveling assist control is started, and the vertical axis represents the target speed of the arm 12 and the boom 13.

The time point when the ground leveling assist control is started indicates a time point when the distance D larger than the threshold H becomes the threshold D.

For example, when the working equipment control unit 61 compares the arm cylinder target speed Var_b before recalculation with the arm cylinder target speed Var_a after recalculation and determines that the arm cylinder target speed Var_b before recalculation is smaller than the arm cylinder target speed Var_a after recalculation, the working equipment control unit 61 determines the arm cylinder target speed Var_b before recalculation as the arm cylinder target speed Var. The working equipment control unit 61 outputs a control signal to the control valve 45 (45A, 45B) so that the arm cylinder 22 operates at the arm cylinder target speed Var_b before recalculation.

Further, when the working equipment control unit 61 compares the arm cylinder target speed Var_b before recalculation with the arm cylinder target speed Var_a after recalculation and determines that the arm cylinder target speed Var_a after recalculation is smaller than the arm cylinder target speed Var_b before recalculation, the working equipment control unit 61 determines the arm cylinder target speed Var_a after recalculation as the arm cylinder target speed Var. The working equipment control unit 61 outputs a control signal to the control valve 45 (45A, 45B) so that the arm cylinder 22 operates at the arm cylinder target speed Var_a after recalculation.

In FIG. 7, a line Var_f indicates the determined arm cylinder target speed Var.

Similarly, when the working equipment control unit 61 compares the boom cylinder target speed Vbm_b before recalculation with the boom cylinder target speed Vbm_a after recalculation and determines that the boom cylinder target speed Vbm_b before recalculation is smaller than the boom cylinder target speed Vbm_a after recalculation, the working equipment control unit 61 determines the boom cylinder target speed Vbm_b before recalculation as the boom cylinder target speed Vbm. The working equipment control unit 61 outputs a control signal to the control valve 45 (45C) so that the boom cylinder 23 operates at the boom cylinder target speed Vbm_b before recalculation.

Further, when the working equipment control unit 61 compares the boom cylinder target speed Vbm_b before recalculation with the boom cylinder target speed Vbm_a after recalculation and determines that the boom cylinder target speed Vbm_a after recalculation is smaller than the boom cylinder target speed Vbm_b before recalculation, the working equipment control unit 61 determines the boom cylinder target speed Vbm_a after recalculation as the boom cylinder target speed Vbm. The working equipment control unit 61 outputs a control signal to the control valve 45 (45C) so that the boom cylinder 23 operates at the boom cylinder target speed Vbm_a after recalculation.

In FIG. 7, a line Vbm_f indicates the determined boom cylinder target speed Vbm.

Correlation data between the control signal output to the control valve 45, the operation speed of the hydraulic cylinder 20, and the operation speed of the working equipment 1 is previously obtained and stored in the storage device 50B. The working equipment control unit 61 can determine the control signal so that the cylinder operates at the cylinder target speed Var, Vbm and output the determined control signal to the control valve 45.

Figure 8:
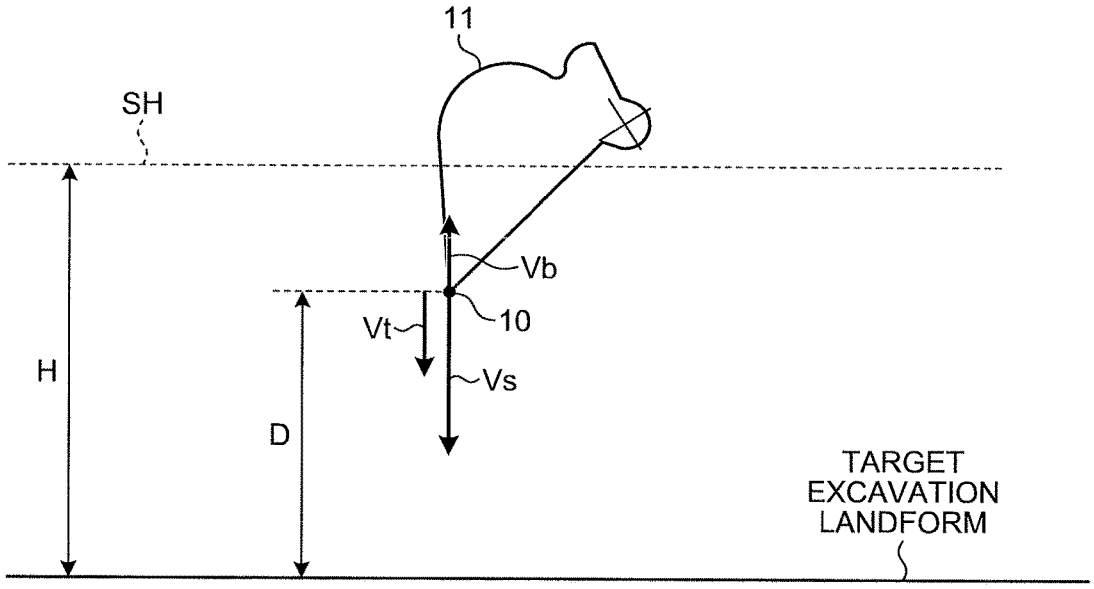
FIG. 8 is a schematic diagram for describing ground leveling assist control according to the present embodiment.

FIG. 8 is a schematic diagram for describing the ground leveling assist control according to the present embodiment. As illustrated in FIG. 8, a speed limit intervention line SH is defined. The speed limit line SH is parallel to the target excavation landform and defined at a position away from the target excavation landform by a distance H. The distance H is a threshold defined for the distance D between the bucket 11 and the target excavation landform. The distance H is desirably set without loss of an operation feeling of the operator.

The distance data acquisition unit 54 acquires the distance D which is the shortest distance between the bucket 11 and the target excavation landform in a normal direction of the target excavation landform. In the example illustrated in FIG. 8, the distance D is defined between the blade edge 10 of the bucket 11 and the target excavation landform. Further, when the distance D is equal to or less than the threshold H, the second target speed calculation unit 60 determines the bucket cylinder target speed Vbk, the arm cylinder target speed Var, and the boom cylinder target speed Vbm in accordance with the above simultaneous equations.

Figure 9:
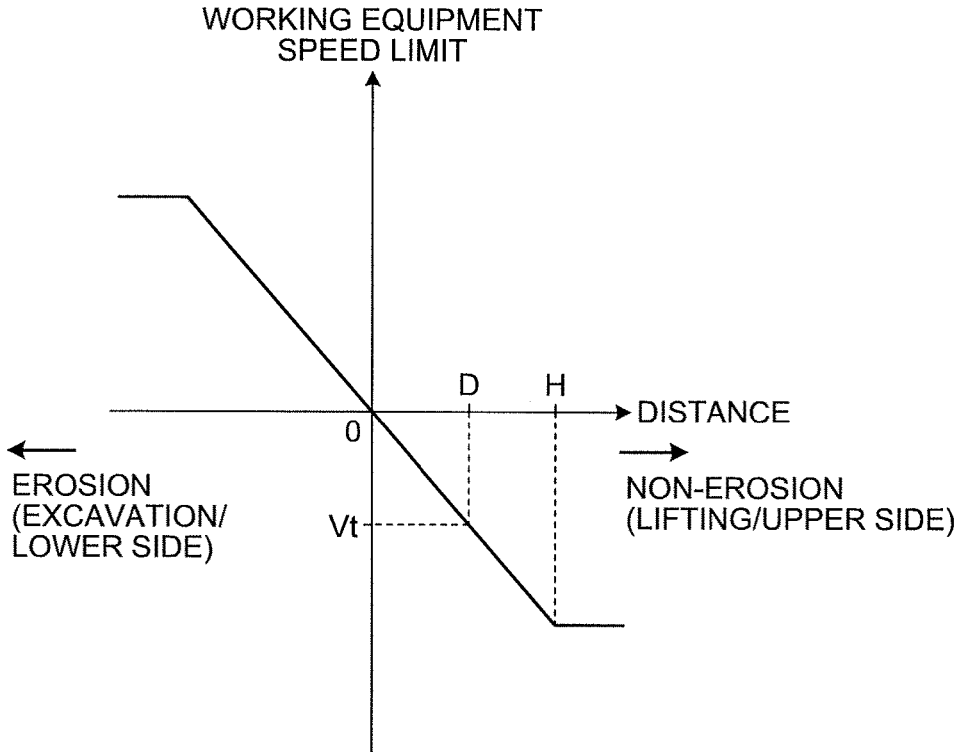
FIG. 9 is a diagram illustrating an example of the relationship between a threshold, a distance, and a target speed of a bucket according to the present embodiment.

FIG. 9 is a diagram illustrating an example of the relationship between the threshold H, the distance D, and the working equipment speed limit Vt of the bucket 11 in the present embodiment. The working equipment speed limit Vt is not set when the distance D is larger than the threshold H, but set when the distance D is equal to or less than the threshold H. As the distance D decreases, the working equipment speed limit decreases. When the distance D becomes zero, the working equipment speed limit Vt also becomes zero. In the present embodiment, the speed when the bucket 11 moves from the lower side to the upper side of the target excavation landform is a positive value, and the speed when the bucket 11 moves from the upper side to the lower side of the target excavation landform is a negative value. The second target speed calculation unit 60 determines the working equipment speed limit Vt so that the absolute value of the working equipment speed limit Vt increases as the distance D increases and the absolute value of the working equipment speed limit Vt decreases as the distance D decreases.

[Relationship Between Maximum Flow Rate and Required Flow Rate]

Figure 10:
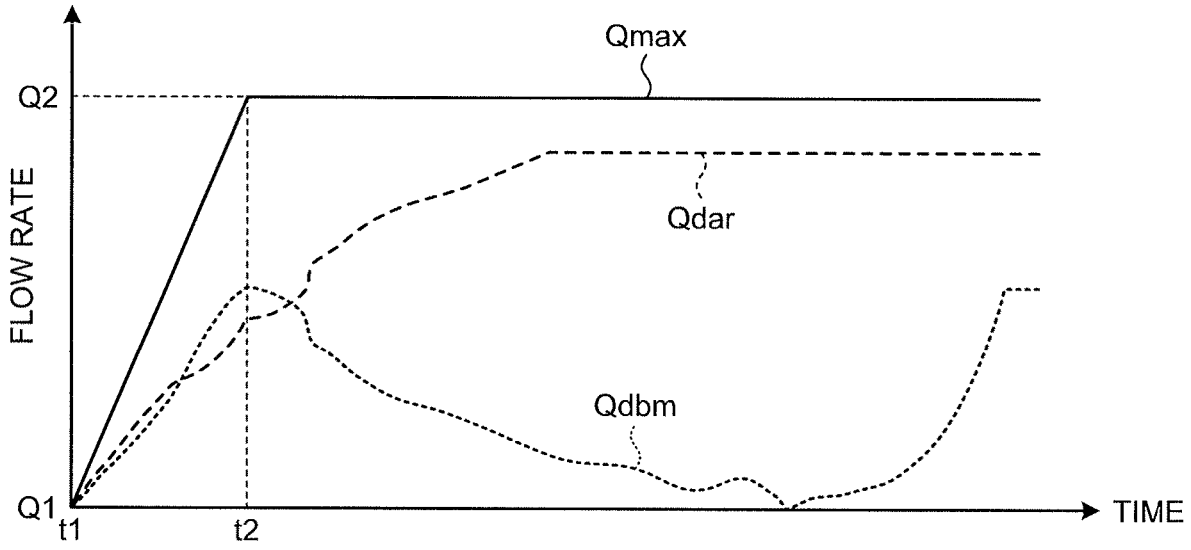
FIG. 10 is a diagram illustrating an example of the relationship between a maximum flow rate and a required flow rate according to the present embodiment.

FIG. 10 is a diagram illustrating an example of the relationship between the maximum flow rate Qmax and the required flow rate Qd according to the present embodiment.

In the graph illustrated in FIG. 10, the vertical axis represents an elapsed time from a time point t1 (first time point) when the ground leveling assist control is started, and the vertical axis represents the flow rate [l/min] of hydraulic oil.

The time point t1 when the ground leveling assist control is started indicates a time point when the distance D larger than the threshold H becomes the threshold D. In the example illustrated in FIG. 10, the maximum flow rate Qmax is zero at the time point t1. However, the maximum flow rate Qmax may be a positive value.

In FIG. 10, a line Qmax is the maximum flow rate calculated by the pump maximum flow rate calculation unit 57. A line Qdar is the required flow rate of the arm cylinder 22. A line Qdbr is the required flow rate of the boom cylinder 23.

As illustrated in FIG. 10, the maximum flow rate Q becomes a first flow rate Q1 at the time point t1 when the ground leveling assist control is started and gradually increases in a specified period between the time point t1 and a time point t2 (second time point) after an elapse of a predetermined time from the time point t1 so as to become a second flow rate Q2 which is larger than the first flow rate Q1 at the time point t2. In the present embodiment, the maximum flow rate Qmax increases in proportion to time between the time point t1 and the time point t2. Note that an increasing rate (inclination) of the maximum flow rate Qmax is always constant regardless of the magnitude of the operation amount of the operation device 40.

In a period after the time point t2, the maximum flow rate Qmax is maintained at the second flow rate Q2. In the present embodiment, the second flow rate Q2 is, for example, the maximum flow rate Qmax when the capacity of the hydraulic pump 42 and the engine speed of the engine 17 show their respective maximum values. That is, in the period after the time point t2, the maximum flow rate Q is determined on the basis of conditions when the swash plate is controlled to the maximum angle so that the hydraulic pump 42 has the maximum capacity and the engine 17 is driven at the highest engine speed.

In the present embodiment, in a specified period after the ground leveling assist control is started at the early stage of excavation, a value of the maximum flow rate Qmax is small. The maximum flow rate Qmax indicates a limiting value of the total flow rate Qdal indicating the sum of the required flow rate Qdar and the required flow rate Qdbm. That is, when the maximum flow rate Qmax is limited to a small value, the required flow rate Qdar and the required flow rate Qdbm are also limited to small values.

Note that, as described above, the pump maximum flow rate calculation unit 57 may set the pump maximum flow rate Qmax within a range in which the maximum flow rate Qmax does not exceed a pump maximum flow rate of hydraulic oil that can be discharged by the hydraulic pump 42. Further, an increasing rate of the flow rate Q may be adjusted so that the flow rate Q increases from the first flow rate Q1 to the second flow rate Q2 within a predetermined time.

[Control Method]

Figure 11:
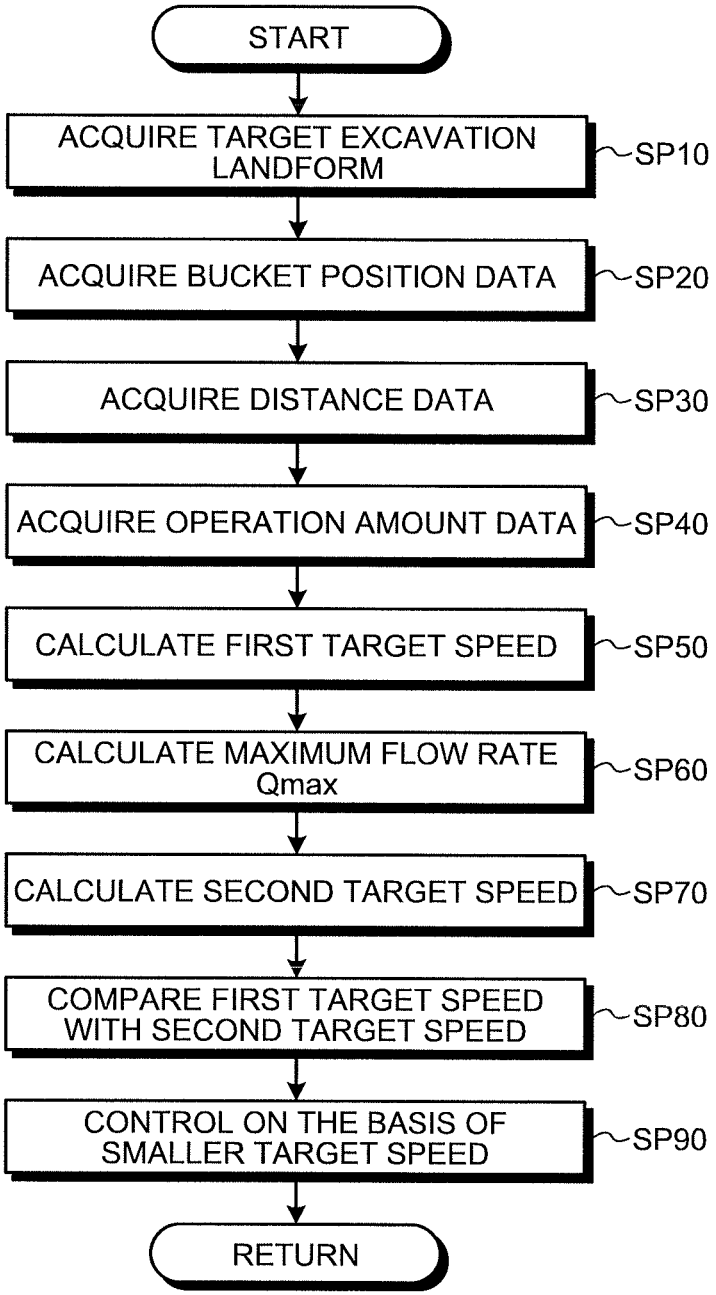
FIG. 11 is a flowchart illustrating an example of a method for controlling the excavator according to the present embodiment.

Next, a method for controlling the excavator 100 according to the present embodiment will be described with reference to FIG. 11. FIG. 11 is a flowchart illustrating the method for controlling the excavator 100 according to the present embodiment.

A target excavation landform is supplied from the target excavation landform data generation device 70 to the control device 50. The target excavation landform data acquisition unit 53 acquires the target excavation landform supplied from the target excavation landform data generation device 70 (step SP10).

Data indicating the position of the bucket 11 is supplied from the blade edge position detector 34 to the control device 50. The bucket position data acquisition unit 52 acquires the position of the bucket 11 from the blade edge position detector 34 (step SP20).

The distance data acquisition unit 54 calculates the distance D between the bucket 11 and the target excavation landform on the basis of the position of the bucket 11 acquired by the bucket position data acquisition unit 52 and the target excavation landform generated by the target excavation landform data acquisition unit 53 (step SP30).

The operation amount data acquisition unit 56 acquires data indicating the operation amount of the operation device 40 which operates the hydraulic cylinder 20 which drives the working equipment 1 (step SP40).

The operation amount data acquisition unit 56 can acquire the operation amount of the operation device 40 which operates the arm 12 on the basis of detection data of the pressure sensors 49A, 49B. Further, the operation amount data acquisition unit 56 can acquire the operation amount of the operation device 40 which operates the boom 13 on the basis of detection data of the pressure sensors 46A, 46B.

The first target speed calculation unit 58 calculates the first target speed of the working equipment 1 on the basis of the operation amount of the operation device 40 and the distance D between the bucket 11 and the target excavation landform (step SP50).

The first target speed includes the bucket cylinder target speed Vbk_b before recalculation, the arm cylinder target speed Var_b before recalculation, and the boom cylinder target speed Vbm_b before recalculation.

The pump maximum flow rate calculation unit 57 calculates the maximum flow rate Qmax of hydraulic oil discharged from the hydraulic pump 42 (step SP60). As described above with reference to FIG. 10, the maximum flow rate Qmax becomes the first flow rate Q1 at the time point t1 when the ground leveling assist control is started, gradually increases in the specified period between the time point t1 and the time point t2 after the elapse of the predetermined time from the time point t1, and becomes the second flow rate Q2 which is larger than the first flow rate Q1 at the time point t2.

The second target speed calculation unit 60 calculates the second target speed of the working equipment 1 on the basis of the maximum flow rate Qmax calculated by the pump maximum flow rate calculation unit 57, the operation amount of the operation device 40, and the distance D between the bucket 11 and the target excavation landform (step SP70).

The second target speed includes the bucket cylinder target speed Vbk_a after recalculation, the arm cylinder target speed Var_a after recalculation, and the boom cylinder target speed Vbm_a after recalculation. The second target speed calculation unit 60 calculates the second target speed by performing arithmetic processing based on the above simultaneous equations.

The working equipment control unit 61 compares the first target speed calculated by the first target speed calculation unit 58 on the basis of the distance D with the second target speed calculated by the second target speed calculation unit 58 (step SP80).

The working equipment control unit 61 determines the smaller one of the first target speed and the second target speed as the target speed of the working equipment 1. The working equipment control unit 61 outputs the control signal for controlling the hydraulic cylinder 20 on the basis of the determined target speed (step SP90).

The working equipment control unit 61 outputs the control signal for controlling the control valve 45 of the hydraulic cylinder 20 so that the working equipment 1 operates at the target speed.

[Effects]

As described above, according to the present embodiment, the first target speed and the second target speed are calculated with the maximum flow rate Qmax of the hydraulic pump 42 set in the ground leveling assist control. The hydraulic cylinder 20 is controlled on the basis of the smaller one of the first target speed and the second target speed. Accordingly, hydraulic oil is supplied to a plurality of hydraulic cylinders 20 at an appropriate flow rate within the range that does not exceed a discharge capacity of the hydraulic pump 42. Thus, a drop of the working equipment 1 is prevented, and reduction in the accuracy of excavation is prevented.

Further, in the present embodiment, the second target speed is calculated so that the total flow rate Qdal indicating the sum of the required flow rates Qd of the plurality of hydraulic cylinders 20 becomes equal to or less than the maximum flow rate Qmax. Accordingly, in the ground leveling assist control, the operation speed of the arm 12 and the operation speed of the boom 13 are kept in balance to prevent a drop of the working equipment 1.

Further, in the present embodiment, the maximum flow rate Qmax is limited in the specified period between the time point t1 and the time point t2 at the early stage of excavation. Accordingly, in the ground leveling assist control, the arm 12 is prevented from operating at a high speed. Thus, at the early stage of excavation, the occurrence of a phenomenon of a drop of the working equipment 1 is prevented. Further, the maximum flow rate Qmax gradually increases in the specified period between the time point t1 and the time point t2. Accordingly, the operation speed of the arm 12 can be gradually increased. Thus, it is possible to prevent reduction in the workability while preventing a drop of the working equipment 1.

Further, in the present embodiment, for example, the maximum flow rate Qmax is determined on the basis of the conditions when the hydraulic pump 42 has the maximum capacity and the engine 17 is driven at the highest engine speed after the time point t2. Accordingly, the working equipment 1 can be operated at a high speed after the early stage of excavation. Thus, it is possible to prevent reduction in the workability while preventing a drop of the working equipment 1.

Note that, in the above embodiment, the operation device 40 is disposed in the excavator 100. However, the operation device 40 may be disposed in a remote place away from the excavator 100, and the excavator 100 may be remotely operated. When the working equipment 1 is remotely operated, the operation device 40 which is disposed in the remote place wirelessly transmits a control signal indicating the operation amount of the working equipment 1 to the excavator 100. The operation amount data acquisition unit 56 of the control device 50 acquires the wirelessly-transmitted control signal indicating the operation amount.

Note that, in the above embodiment, the work machine 100 is the excavator 100. The control device 50 and the control method described in the above embodiment are also applicable to all work machines having working equipment in addition to the excavator 100.

REFERENCE SIGNS LIST

1 working equipment
2 upper structure
3 undercarriage
4 cab
4S driver seat
5 machine room
6 handrail
7 crawler
10 blade edge
11 bucket
12 arm
13 boom
14 bucket cylinder stroke sensor
15 arm cylinder stroke sensor
16 boom cylinder stroke sensor
17 engine
18 servomechanism
20 hydraulic cylinder

20A cap side oil chamber
20B rod side oil chamber
21 bucket cylinder
22 arm cylinder
23 boom cylinder
30 position detection device
31 vehicle body position detector
31A GPS antenna
32 attitude detector
33 direction detector
34 blade edge position detector
40 operation device
41 direction control valve
42 hydraulic pump
43 hydraulic pump
44A, 44B, 44C oil passage
45A, 45B, 45C control valve
46A, 46B pressure sensor
47A, 47B oil passage
48 shuttle valve
49A, 49B pressure sensor
50 control device
50A processing device
50B storage device
50C input/output interface device
51 vehicle position data acquisition unit
52 bucket position data acquisition unit
53 target excavation landform data acquisition unit
54 distance data acquisition unit
56 operation amount data acquisition unit
57 pump maximum flow rate calculation unit
58 first target speed calculation unit
60 second target speed calculation unit
61 working equipment control unit
70 target excavation landform data generation device
100 excavator (work machine)
200 control system
300 hydraulic system
AX1 rotation axis
AX2 rotation axis
AX3 rotation axis
L11 length
L12 length
L13 length
Pb absolute position of blade edge
Pg absolute position of upper structure
RX swing axis
θ11 attitude angle
θ12 attitude angle
θ13 attitude angle

The invention claimed is:

1. A control system for controlling a work machine, the work machine including working equipment, the working equipment including a bucket, an arm, and a boom, the control system comprising:

at least one processor configured to:

calculate a maximum flow rate of hydraulic oil discharged from a hydraulic pump;

calculate a first target speed of the working equipment on the basis of an operation amount of an operation device that is operated for driving a plurality of hydraulic actuators to which the hydraulic oil discharged from the hydraulic pump is supplied to drive the working equipment and a distance between the bucket and a target excavation landform;

calculate a second target speed of the working equipment on the basis of the maximum flow rate, and the operation amount of the operation device and the distance between the bucket and the target excavation landform; and determine a smaller one of the first target speed and the second target speed as the target speed of the working equipment, and output a control signal for controlling the hydraulic actuators on the basis of the smaller one of the first target speed and the second target speed, wherein the at least one processor is configured to calculate the second target speed such that a total flow rate indicating a sum of the required flow rates of a plurality of the hydraulic actuators becomes equal to or less than the maximum flow rate, wherein the at least one processor is configured to calculate the first target speed on the basis of the operation amount when the distance is larger than a threshold and calculates the first target speed on the basis of the distance when the distance is equal to or less than the threshold, and the maximum flow rate becomes a first flow rate at a first time point when the distance larger than the threshold becomes the threshold and increases in a specified period between the first time point and a second time point after an elapse of a predetermined time from the first time point such that the maximum flow rate becomes a second flow rate larger than the first flow rate at the second time point, wherein the maximum flow rate is calculated on the basis of at least either a capacity of the hydraulic pump or an engine speed of an engine configured to drive the hydraulic pump, and the second flow rate is the maximum flow rate when the capacity and the engine speed indicate respective maximum values, and wherein the at least one processor is configured to start a ground leveling assist control at the first time point when the distance larger than the threshold becomes the threshold.

2. The control system for controlling the work machine according to claim 1, wherein the hydraulic actuators include an arm cylinder configured to drive the arm and a boom cylinder configured to drive the boom, and the total flow rate indicates a sum of the required flow rate of the arm cylinder and the required flow rate of the boom cylinder.

3. A method for controlling a work machine, the work machine including working equipment, the working equipment including a bucket, an arm, and a boom, the method comprising:

calculating a maximum flow rate of hydraulic oil discharged from a hydraulic pump;

calculating a first target speed of the working equipment on the basis of an operation amount of an operation device that is operated for driving a plurality of hydraulic actuators to which the hydraulic oil discharged from the hydraulic pump is supplied to drive the working equipment and a distance between the bucket and a target excavation landform;

calculating a second target speed of the working equipment on the basis of the maximum flow rate, and the operation amount of the operation device and the distance between the bucket and the target excavation landform;

determining a smaller one of the first target speed and the second target speed as the target speed of the working equipment; and outputting a control signal for controlling the hydraulic actuators on the basis of the smaller one of the first target speed and the second target speed, wherein the second target speed is calculated such that a total flow rate indicating a sum of the required flow rates of a plurality of the hydraulic actuators becomes equal to or less than the maximum flow rate, wherein the first target speed is calculated on the basis of the operation amount when the distance is larger than a threshold and the first target speed is calculated on the basis of the distance when the distance is equal to or less than the threshold, and the maximum flow rate becomes a first flow rate at a first time point when the distance larger than the threshold becomes the threshold and increases in a specified period between the first time point and a second time point after an elapse of a predetermined time from the first time point such that the maximum flow rate becomes a second flow rate larger than the first flow rate at the second time point, wherein the maximum flow rate is calculated on the basis of at least either a capacity of the hydraulic pump or an engine speed of an engine configured to drive the hydraulic pump, and the second flow rate is the maximum flow rate when the capacity and the engine speed indicate respective maximum values, and wherein the at least one processor is configured to start a ground leveling assist control at the first time point when the distance larger than the threshold becomes the threshold.

4. The control system of the work machine according to claim 1, wherein the first and second target speeds of the working equipment are calculated with the maximum flow rate of the hydraulic pump set in a ground leveling assist control.

* * * * *